United States Patent [19]

Kulick

[11] Patent Number: 4,509,644

[45] Date of Patent: Apr. 9, 1985

[54] WATCH CRYSTAL COVER AND PACKAGE ASSEMBLY

[76] Inventor: John M. Kulick, 50 E. Hill Rd., Canton, Conn. 06019

[21] Appl. No.: 504,791

[22] Filed: Jun. 16, 1983

[51] Int. Cl.[3] ..... B65D 65/40

[52] U.S. Cl. ..... 206/461; 63/24; 150/52 R; 206/5; 206/447; 368/283; 368/286

[58] Field of Search ..... 29/160.6, 177, 179; 63/21, 24; 150/52 R; 206/5, 6, 18, 447, 449, 450, 460–472; 220/281, 282; 224/164–170; 368/281–283, 286, 288, 289, 291, 294–296; 426/389, 414

[56] References Cited

U.S. PATENT DOCUMENTS

| | | | |
|---|---|---|---|
| 1,249,906 | 1/1916 | Daw . | |
| 1,503,097 | 7/1924 | Daving . | |
| 1,767,315 | 5/1928 | Schreiber . | |
| 2,249,550 | 7/1941 | Williams | 368/281 |
| 2,511,329 | 6/1950 | Craig | 206/6 |
| 2,547,487 | 4/1951 | Penny | 206/447 |
| 2,582,473 | 11/1946 | Belfert . | |
| 2,635,416 | 4/1953 | Mietchen | 224/170 |
| 2,666,710 | 1/1954 | Peters | 206/457 |
| 2,692,070 | 10/1970 | Kammer | 368/286 |
| 2,745,580 | 10/1951 | Ward . | |
| 3,584,455 | 6/1971 | Sion | 368/283 |
| 4,076,207 | 2/1978 | Austin | 426/389 |
| 4,155,219 | 5/1979 | Anderson | 368/283 |
| 4,277,842 | 7/1981 | Richards | 368/282 |
| 4,355,720 | 10/1982 | Hofberg et al. | 204/472 |

*Primary Examiner*—George E. Lowrance
*Assistant Examiner*—Jimmy G. Foster

[57] ABSTRACT

A protective cover is provided for a watch crystal, which is initially in the form of a depressed portion in a plastic cover member, the convex side thereof being adherent to the crystal. To achieve full application, the depression is inverted over the surface of the crystal, and is then excised from the remainder of the sheet or film. The cover member is preferably provided as a component of a package which also includes a backing board and interposed insert piece, the latter being used to strip the cover member from the backing board.

8 Claims, 6 Drawing Figures

WATCH CRYSTAL COVER AND PACKAGE ASSEMBLY

BACKGROUND OF THE INVENTION

As is well known, watch crystals, and particularly those of wristwatches, are normally subjected to considerable abuse, and often become badly scratched or marred as a result; indeed, it is not uncommon for the crystal to be cracked or broken. While it has previously been proposed in the art to provide means for protecting such crystals, as far as is known no commercially satisfactory protective cover has heretofore been proposed, nor has there been provided a convenient means of packaging and marketing such an item.

Examplary of the relevant prior art is Daw U.S. Pat. No. 1,249,906, wherein a metal protector for a wristwatch is disclosed, which is slotted to provide a Venetian blind-like structure. Daving U.S. Pat. No. 1,503,097 discloses a protective and decorative cover plate for a watch; a protective watch cover having a transparent portion to permit viewing is shown in Schreiber U.S. Pat. No. 1,767,315, and a somewhat similar unit is taught in Belfert U.S. Pat. No. 2,582,473. Mietchen U.S. Pat. No. 2,635,416 discloses a snap-together cover and base assembly, and Kammer U.S. Pat. No. 2,692,070 discloses a plastic bracelet within which the works of a watch may be contained. A protective guard is shown in Ward U.S. Pat. No. 2,745,580, and a unit having portions that slide under the wrist band, to position the covering element, is taught in Sion U.S. Pat. No. 3,584,455. Finally, Richards U.S. Pat. No. 4,277,842 discloses a bracelet-like assembly which is designed to be placed over a watch to protect it against abuse.

Accordingly, it is an object of the present invention to provide a novel article and method by which an effective protective covering for a watch crystal is readily provided.

It is also an object of the invention to provide a novel package assembly, which is specifically adapted for the packaging and marketing of a cover member suitable for use to provide such a covering.

It is another object of the invention to provide such a novel article and assembly which are relatively simple in design and inexpensive to manufacture, and to provide such a novel method which is convenient and facile to carry out.

SUMMARY OF THE DISCLOSURE

It has now been found that certain of the foregoing and related objects of the invention are readily attained in an assembly comprising a backing board, a crystal cover member, and an insert piece interposed therebetween. The cover member is fabricated from a deformable sheet or film of clear synthetic resinous material; it has a depressed portion formed therein which is dimensioned and configured to protectively overlie a watch crystal, and an adhesive surface layer (preferably a coating on the cover member) secures the cover member to the backing board and the insert piece. The latter is dimensioned and configured to lie inwardly of first marginal portions of the cover member, and also to provide a tab portion extending outwardly of a second marginal portion thereof. The "first" marginal portions are bonded to the backing board to secure the cover member, and the tab portion provides means for lifting, and effecting the removal of, the cover member.

In preferred embodiments of the assembly, the insert piece will extend beneath the depressed portion of the cover member, and will have a similarly depressed portion which conforms to and either nests the depressed portion of the cover member, or is nested thereby. It is especially desirable that the backing board be formed with an opening which is dimensioned and configured to receive the depressed portion of the insert piece.

Most desirably, both the insert piece and the cover member will be of generally rectangular configuration, and will be coaxially disposed. The cover member will, in such embodiments, be wider than the insert piece, so that the resultant overhanging marginal strips will provide the "first" marginal portions of the cover member. The insert piece will normally comprise a strip of synthetic resinous sheet material, and will have both of its opposite end portions projecting beyond the cover member, to provide a pair of tab portions. The adhesive surface on the cover member will usually constitute a coating of a pressure sensitive adhesive material, and will be of such nature as to permit facile peeling of the cover member from the backing board and insert piece.

Other objects of the invention are attained by the provision of an article comprising a cover member fabricated from a deformable sheet or film of clear synthetic resinous material. The cover member has a depressed portion formed therein which is dimensioned and configured to protectively overlie a watch crystal, and an adhesive surface layer is provided on at least the convex side of the depressed portion.

Further objects of the invention are attained in a method for protecting a watch crystal, which includes the step of providing a cover member of the nature hereinabove described. The cover member is applied with the convex side of its depression in registered contact with the watch crystal, following which the depressed portion is inverted to bring the film or sheet into close conformity with the crystal, and to adhesively secure it thereto. The depressed portion is finally excised from the cover member to leave the protective cover on the crystal.

DETAILED DESCRIPTION OF THE ILLUSTRATED EMBODIMENTS

Figure 1:
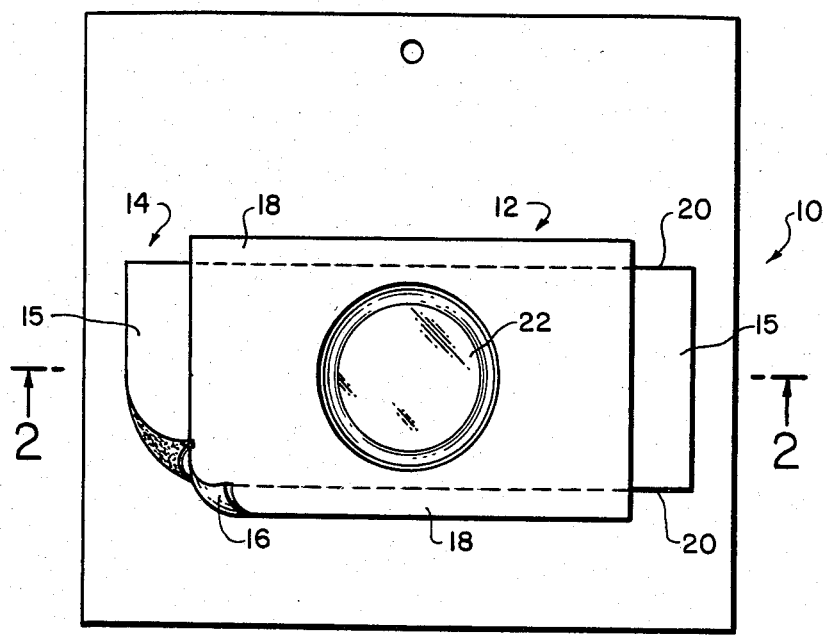
FIG. 1 is a plan view of a watch crystal protective cover assembly embodying the present invention, showing one corner of the insert piece lifted away from the backing board, preliminary to peeling the cover member away therefrom.
Figure 4:
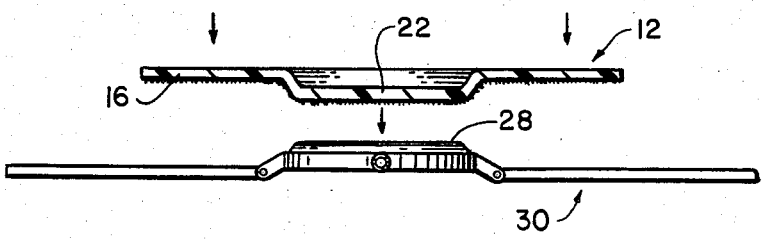
FIG. 4 is an exploded elevational view, drawn to the scale of FIG. 1, showing the cover member in cross-section and registered with the crystal of a wristwatch, just prior to application thereto.

The assembly shown in FIG. 1 includes a backing board, generally designated by the numeral 10, a crystal cover member, generally designated by the numeral 12, and an insert piece, generally designated by the numeral 14, interposed therebetween. The underside 16 of the cover member 12 is coated with a pressure-sensitive adhesive material (as shown in FIG. 4), by which the member 12 is secured to the backing board 10 and the insert 14; as will be appreciated, adhesion to the backing board 10 occurs only in the overhanging marginal strip areas 18, lying beyond the side edges 20 of the insert piece 14.

Figure 2:
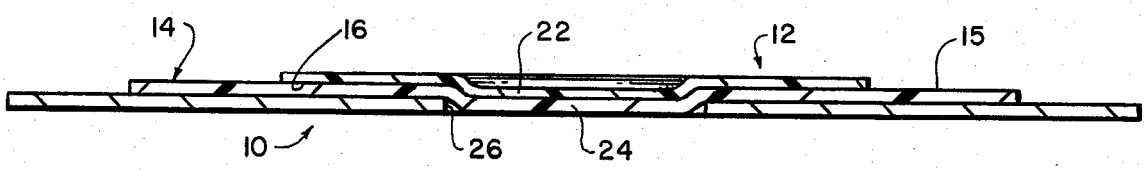
FIG. 2 is a sectional view of the assembly of FIG. 1, taken along line 2—2 and drawn to an enlarged scale, which depicts a preferred embodiment of the invention.
Figure 3:
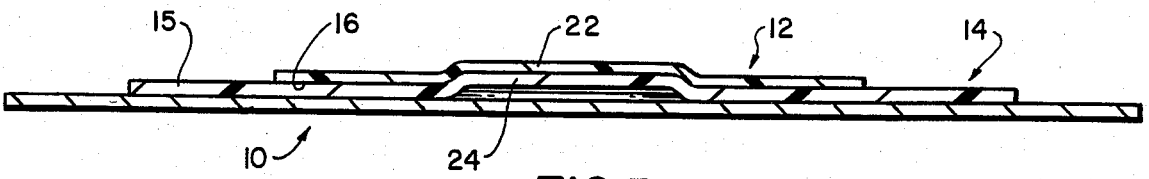
FIG. 3 is a similar view of a second embodiment of the cover assembly of the invention, which may also be regarded as illustrated by FIG. 1.

The cover member 12 has a circular depressed portion 22 formed thereinto at a centralized location, which may project either to the adhesive-coated side 16 of the cover member 12 (as in FIG. 2) or to the opposite side (as in FIG. 3). In either event, the insert piece 14 will have a similarly dimensioned and configured depressed portion 24, to which the depressed portion 22 will closely conform. In the embodiment of FIG. 2 the depressed portion 22 is nested within the portion 24 of the insert 14, whereas in the embodiment of FIG. 3 the reverse relationship exists. To accommodate the inward protrusion of the depressed portions 22, 24, in the form of the assembly shown in FIG. 2, the backing board 10 is provided with a corresponding circular opening 26. This arrangement will generally be preferred, not only because of the more compact nature of the resultant package, but also because of the increased level of protection that is afforded for the cover portion.

To use the cover member, it will of course be necessary to first remove it from the backing board 10, which can readily be accomplished by lifting one corner of an extending tab portion 15 of the insert piece 14 (as shown in FIG. 1), using it to peel the cover member 12 away from the backing board. The cover member can in turn be stripped from the insert piece, simply by pulling them apart, whereupon it will be ready for application, as shown in FIG. 4 of the drawings.

It should be noted here that to ensure successful application the depressed portion 22 must project to the adhesive-coated side 16 of the member (i.e., the convex side of the portion 22 must carry the adhesive coating). It is evident that this will inherently occur when the form of the assembly shown in FIG. 2 is employed; while perhaps less obvious, it will readily be appreciated that the same condition will result when using the assembly of FIG. 3, due to the inversion of the depressed portion that will occur when the cover member 12 is stripped from the insert piece 14.

Figure 5:
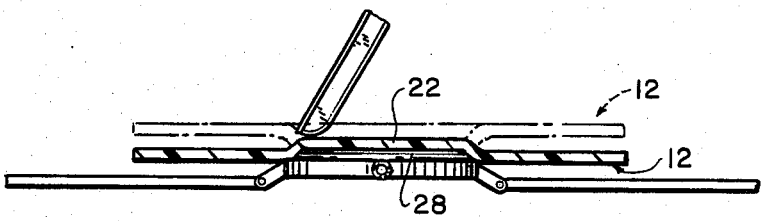
FIG. 5 is a view similar to FIG. 4, showing (in phantom line) the cover member as initially applied to the crystal, and showing (in full line) its subsequent inversion for ultimate positioning, FIG. 5 also showing a fragmentarily illustrated knife blade in position for excising the covering portion from the member.
Figure 6:
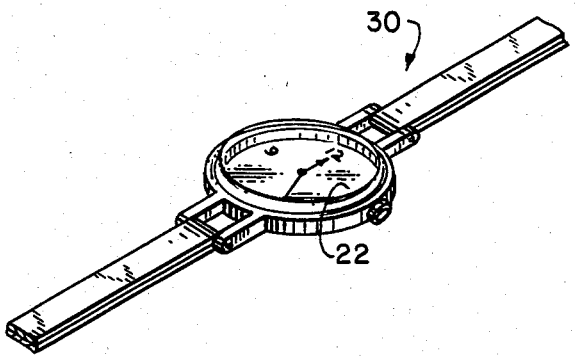
FIG. 6 is a perspective view of a wristwatch with the protective cover in place.

To apply the cover member, it is simply a matter of first aligning the depressed portion 22 over the crystal 28 of the watch, generally designated by the numeral 30, as in FIG. 4. The member 12 is moved to the position shown in phantom line in FIG. 5, to bring the adhesive surface 16 into contact with the top surface of the crystal 28 and to achieve initial adhesion. The surrounding portion 32 of the cover member will then be displaced downwardly to bring the circumferential portion of the cover into intimate contact with the periphery of the crystal 28, as shown in the full line representation of FIG. 5. Finally, the depressed portion 22 can be excised from the portion 32, such as by running a knife blade 32 about the base of the crystal 28; the watch 30, with its crystal protected by the resultant covering element (constituted by the depressed portion 22), is shown in FIG. 6.

As stated hereinabove, the crystal cover member will be fabricated from a sheet or film of synthetic (normally thermoplastic) resinous material. This will not only result in a clear covering that will protect the crystal against surface scratching and marring, and will cushion and reinforce it against cracking and breaking, but will also facilitate manufacture of the article and assembly. For example, when a thin plastic tape is employed for the production of the cover member, the method may entail preheating the tape and applying it to a vacuum forming roller. The necessary depression can readily be produced during movement of the tape about the roller, and application to the backing board can occur either with the tape still warm and tacky, or after it has been brought to room temperature; in the former case, it may be feasible to dispense with any added adhesive material to create the required bonding. The piece from which the insert is to be formed can also be preapplied to the tape, with the combination or preassembly passing through the heating area to an appropriate mold, thereby enabling simultaneous forming of the cover member and the insert piece.

It should be appreciated that either a film or sheet material can be used for the cover member, and that it can be relatively flaccid or relatively rigid and self-supporting. A flaccid film may facilitate conformation to the surface of the watch crystal (and indeed, a stretch film may be used to provide even more latitude for application to crystals of different sizes and shapes); such materials may, however, have a tendency to wrinkle. Generally, the more rigid the material used to fabricate the cover member, the thinner its gauge must be. This is necessary to avoid exceeding the elastic limit of the material during application of the cover, which will often produce areas that are opaque or translucent, rather than transparent. Typically, the film will vary from about 4 to 50 mils, depending upon the inherent elasticity of the material used.

The insert piece will generally be made from relatively rigid thermoplastic sheet material, although a stiff cardboard element may be employed; while the backing board will generally be made of a heavy weight paper or cardboard, it too may be of plastic construction if so desired. The particular plastic used for the various members will be evident to those skilled in the art; typical suitable resins might be mentioned, however, and include the polyethylenes, polypropylenes, polyvinyl chlorides, vinylidene chloride copolymers, polyesters, polyamides, polycarbonates, etc., depending upon the properties desired.

As indicated above, the adhesive surface on the cover member can be provided either inherently, by the thermoplastic from which the member may be fabricated, or as an added coating, which may, for example, be a coextruded layer of ethylene/vinyl acetate copolymer, ethylene/acrylic or methacrylic acid copolymer, Surlyn ionomer, or the like. Normally, however, a pressure-sensitive adhesive material will simply be applied to the cover member film or sheet in a separate operation. Although less practical, the adhesive substance might be provided on the upper surfaces of the insert piece and the backing board, such as by applying a pressure-sensitive or heat activated adhesive material thereto, so long as adequate release and transfer to the cover member will occur for ultimate adhesion to the watch crystal. Finally, it will be appreciated that the operative surfaces of the backing board and insert piece must be adopted to function with the adhesive surface to permit facile release for removal of the covering member at the time of use, and that the backing board will generally bear appropriate application instructions, decorative and advertising matter, and the like.

Thus, it can be seen that the present invention provides a novel article and method by which an effective protective covering for a watch crystal is furnished. The invention also provides a novel package assembly which is specifically adapted for the packaging and marketing of a cover member suitable for use to provide such a covering. The article and assembly are relatively simple in design and inexpensive to manufacture, and the method is convenient and facile to carry out.

Having thus described the invention, what is claimed is:

1. A watch crystal protective cover assembly, comprising:

a backing board;

a crystal cover member fabricated from a deformable sheet or film of clear synthetic resinous material, said cover member having formed therein a depressed portion dimensioned and configured to protectively overlie a watch crystal;

an insert piece interposed between said cover member and said backing board, said insert piece being dimensioned and configured to lie inwardly of first marginal portions of said cover member, and also to provide a tab portion extending outwardly of a second marginal portion thereof, said insert piece extending beneath said depressed portion of said cover member and having formed therein a similarly depressed portion conforming thereto, said depressed portion of said cover member being nested within said depressed portion of said insert piece, or vice versa;

and an adhesive surface layer bonding said cover member in substantially full surface contact to said backing board and said insert piece, said first marginal portions of said cover member being bonded by said adhesive layer to said backing board, and said tab portion of said insert piece providing means for lifting, and effecting the removal of, said cover member.

2. The assembly of claim 1 wherein said backing board has an opening formed therein dimensioned and configured to conform to said depressed portion of said insert piece, said depressed portion being received therewithin.

3. The assembly of claim 1 wherein said insert piece and said cover member are coaxially disposed and are both of generally rectangular configuration, said cover member being wider than said insert piece so that the resultant overhanging marginal strips provide said first marginal portions of said cover member.

4. The assembly of claim 3 wherein said insert piece comprises a strip of synthetic resinous material, opposite end portions of said strip extending outwardly of said cover member and providing two of said tab portions thereon.

5. The assembly of claim 1 wherein said adhesive surface layer comprises a coating of a pressure sensitive adhesive material on said cover member, said adhesive material and the facing surfaces of said backing board and insert piece being of such nature as to permit facile peeling of said cover member therefrom.

6. The assembly of claim 1 wherein said cover member has an adhesive surface layer at least on the convex side of said depressed portion.

7. The assembly of claim 1 wherein said adhesive surface layer comprises a coating of adhesive material.

8. In a method for protecting a watch crystal, the steps comprising: providing a cover member by forming into a deformable sheet or film of clear synthetic resinous material and depressed portion dimensioned and configured to protectively overlie a watch crystal; providing an adhesive surface layer on said cover member, at least on the convex side of said depressed portion; applying said cover member to the watch crystal with said convex side in registered contact therewith; applying force to the portion of said sheet or film surrounding said depressed portion to displace it downwardly, thereby inverting said depressed portion to render said convex side concave; applying pressure to bring said film or sheet into close conformity and intimate contact with substantially the entire exposed surface of said watch crystal, to adhesively secure it thereto; and excising said inverted depressed portion from the remainder of said cover member to provide said protective cover on said crystal.

* * * * *

UNITED STATES PATENT AND TRADEMARK OFFICE

CERTIFICATE OF CORRECTION

PATENT NO. : 4,509,644

DATED : April 9, 1985

INVENTOR(S) : John M. Kulick

It is certified that error appears in the above—identified patent and that said Letters Patent is hereby corrected as shown below:

Column 6, line 31, the word "and" should be "a".

Signed and Sealed this

*Twenty-seventh* Day of *August 1985*

[SEAL]

*Attest:*

DONALD J. QUIGG

*Attesting Officer* *Acting Commissioner of Patents and Trademarks*